US010150592B2

(12) United States Patent
Hartley

(10) Patent No.: US 10,150,592 B2
(45) Date of Patent: Dec. 11, 2018

(54) CONTAINER THAT CAN BE REMOVEABLY ADHERED TO A SHOWER WALL

(71) Applicant: SONOCO DEVELOPMENT, INC, Hartsville, SC (US)

(72) Inventor: Scott Huntington Hartley, Columbia, SC (US)

(73) Assignee: Sonoco Development, Inc., Hartsville, SC (US)

( * ) Notice: Subject to any disclaimer, the term of this patent is extended or adjusted under 35 U.S.C. 154(b) by 347 days.

(21) Appl. No.: 14/948,574

(22) Filed: Nov. 23, 2015

(65) Prior Publication Data

US 2017/0144796 A1 May 25, 2017

(51) Int. Cl.
*F16B 47/00* (2006.01)
*B65D 23/00* (2006.01)

(52) U.S. Cl.
CPC ..... *B65D 23/003* (2013.01)

(58) Field of Classification Search
CPC ..... A45D 37/00; A47M 3/0266; A47K 3/285
See application file for complete search history.

(56) References Cited

U.S. PATENT DOCUMENTS 1,652,488 A 12/1927 Lundblad
2,024,429 A * 12/1935 Casey ..... A61M 3/0266 248/205.5
3,608,853 A 9/1971 Sertich
4,024,312 A 5/1977 Korpman
4,417,362 A 11/1983 Walker
4,470,523 A 9/1984 Spector
5,749,490 A 5/1998 Keicher
6,001,471 A 12/1999 Bries et al.
6,228,070 B1 * 5/2001 Mezzoli ..... A61H 35/04 604/257
6,295,663 B1 * 10/2001 Haller ..... A47K 3/285 126/626
6,406,781 B1 6/2002 Hamerski
6,541,089 B1 4/2003 Hamerski et al.
7,229,059 B1 6/2007 Hood
7,641,167 B2 1/2010 Sheffield, Jr. et al.
7,975,971 B2 * 7/2011 Carnevali ..... F16B 47/00 248/205.5
8,333,354 B2 12/2012 Tooley et al.
8,746,901 B1 6/2014 Zadro
2004/0026455 A1 2/2004 Rutherford et al.
2005/0108294 A1 5/2005 Koerner et al.
2007/0275209 A1 * 11/2007 Netravali ..... A47G 27/0206 428/99

FOREIGN PATENT DOCUMENTS

EP 1531710 5/2005

* cited by examiner

*Primary Examiner* — Amy J. Sterling
(74) *Attorney, Agent, or Firm* — Miller, Matthias & Hull LLP

(57) ABSTRACT

A flexible container that can be affixed to a vertical surface such as a shower wall is provided. The container comprises a wall and a substrate affixed to the wall. The substrate may define a plurality of integrally formed recesses that can create a suction fit with the vertical surface.

15 Claims, 6 Drawing Sheets

CONTAINER THAT CAN BE REMOVEABLY ADHERED TO A SHOWER WALL

BACKGROUND OF THE INVENTION

Field of the Invention

This invention patent relates to a container that can be removably affixed to a vertical surface. More particularly, this invention relates to a container that can be removably affixed to a wet shower wall.

Description of the Related Art

Shower products such as shampoo and body wash often are packaged in bottles that may be stored in shower caddies or simply placed on the shower stall floor, creating clutter. The present disclosure addresses this problem.

BRIEF SUMMARY OF THE INVENTION

The present invention is a container that can be affixed to a vertical surface such as a shower wall. The container holds a flowable product and comprises a wall and a substrate affixed to the wall. The substrate defines a plurality of small integrally formed recesses that can form a suction fit with the vertical surface. The substrate may be made from a water resistant silicone polymer. The product may be a personal care product such as body wash or shampoo. The container may be mounted to the vertical surface with a nozzle pointing down. The user may dispense the product by applying pressure to the container, such as with the user's hand or arm.

In one aspect each recess is a semi-spherical depression having an outer facing concave surface and a rim. During use the concave surface of each recess and the vertical surface define pockets having a partial vacuum.

In another aspect the recesses are grooves. The grooves may extend substantially vertically from an end of the container to a nozzle opposite the end.

In yet another aspect the recesses comprise V-shape grooves having an apex and two legs extending downward from the apex.

The disclosure also relates to a method of adhering a container to a vertical surface comprising the steps of:

providing one of the containers described above;

positioning the container such that the substrate is contacting the vertical surface and the substrate and the vertical surface define pockets filled with air;

applying pressure to the front wall so that air is released from the pockets to create a partial vacuum in the pockets; and releasing the pressure, leaving the container adhered to the vertical surface via suction.

During the pressure application step, channels may be created that temporarily enable the recesses to communicate with the exterior until the pressure is released.

DETAILED DESCRIPTION OF THE INVENTION

Figure 1:
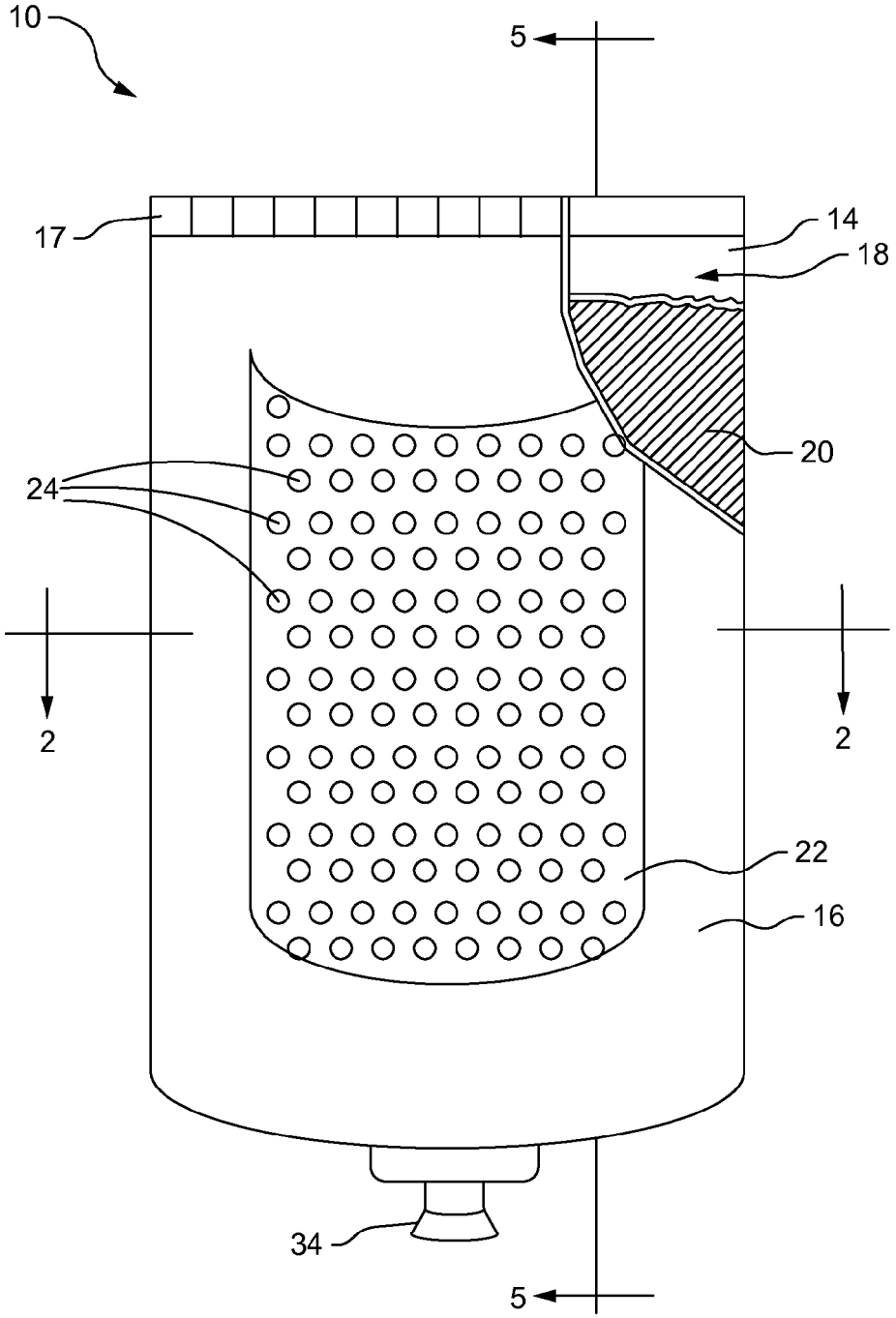
FIG. 1 is a partial cutaway rear view of a container according to the disclosure.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

As will be appreciated, terms such as "horizontal," "vertical," "left," "right," "up," "down," "top," "bottom," "front" and "back," (etc.), used as nouns, adjectives or adverbs (e.g. "horizontally, "rightward," "upwardly," "downwardly," etc.) refer in this description to the orientation of the structure of the container with respect to the vertical surface to which it may be affixed. The terms "integral", "integrally connected" or "integrally formed" when used to describe the relationship between two or more structures means that the structures are comprised of a single piece of material. Such terms are not intended to limit the invention to a particular orientation. Similar or identical features in the various embodiments may be given the same element number. Finally, the drawings are not necessarily drawn to scale, and the features shown therein may be larger or smaller than shown.

Turning to the drawings, there is shown in FIG. 1 a rear view of a container 10 according to the disclosure. The container 10 may comprise a flexible front wall 14 and a flexible rear wall 16. The front and rear walls 14, 16 define an interior 18 for holding a fluid product 20 such as shampoo or liquid soap. The front and rear walls 14, 16 may come together at the top to form a crimped end 17. Alternatively, the top may be sealed by other means, and may include an additional top panel 46 (see FIGS. 6-8) that seals the top of the container.

The product 20 may be dispensed through a reclosable nozzle 34 located at the bottom of the container 10 opposite the crimped end 17.

A substrate 22 is affixed to the rear wall 16. The substrate 22 may be laminated to, coextruded with or otherwise affixed to the rear wall 16. The substrate 22 may or may not be removable. The substrate 22 may be made of any suitable flexible material such as a silicone polymer or rubber, and preferably is water-resistant. A plurality of recesses 24 are integrally formed in the substrate 22 by laser ablation, etching, embossing or other means.

Figure 2:
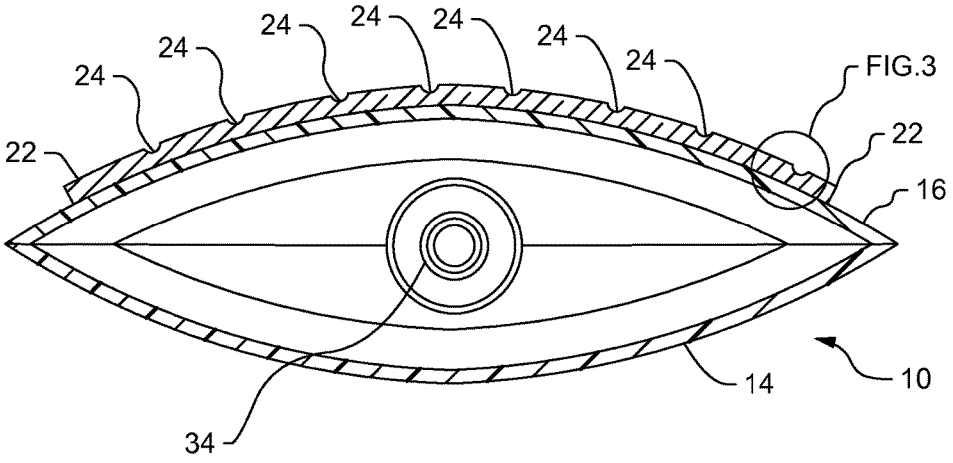
FIG. 2 is a cross-sectional view of the container of FIG. 1 taken along line 2-2 with the container product removed for clarity.

FIG. 2 is a close up cross-sectional view of the container of FIG. 1 take along line 2-2 with the container product 20 removed for clarity. The recesses 24 may take the form of discrete semi-spherical depressions as shown in FIGS. 1-4. However, it is contemplated that the recesses may be any suitable shape that enables the container 10 to adhere to a vertical surface.

Figure 3:
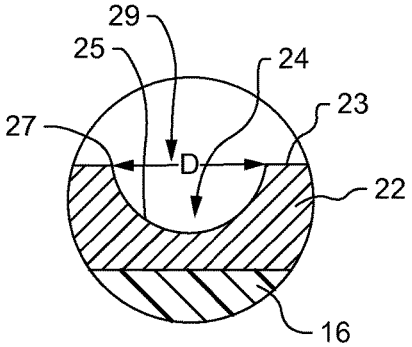
FIG. 3 is a close up view of a portion of the container of FIG. 2.

FIG. 3 is a close up view of a portion of the container of FIG. 2. Each recess 24 is defined by the outer surface 23 of the substrate 22 and, more particularly, by an outer facing substantially concave surface 25 formed in the substrate 22. Each recess 24 may have a substantially circular rim 27 that is co-planar with the substrate outer surface 23. The rim 27 defines an opening 29 having a diameter (D). The diameter (D) may be the same for all recesses 24 or may vary. The recesses 24 may be macroscopic in size (easily seen by the naked eye) or microscopic. The number of recesses 24 may exceed 100 or even 1000.

Figure 4:
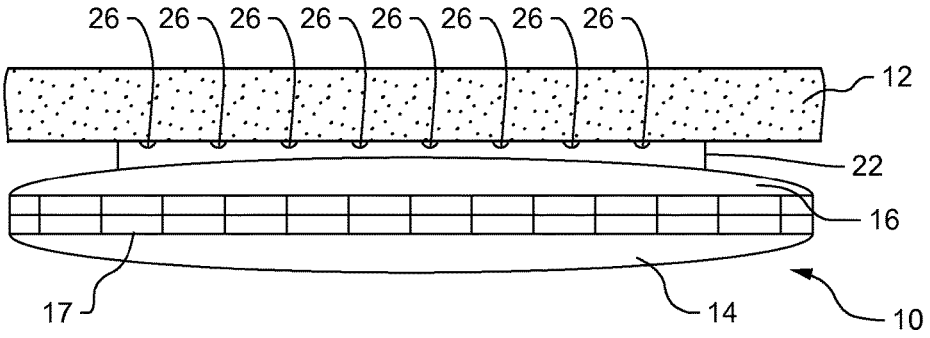
FIG. 4 is a top view the container 10 of FIG. 1 shown affixed to a vertical surface.

FIG. 4 is a top view the container 10 of FIG. 1 shown affixed to a vertical surface 12. When the substrate 22 is initially positioned against a vertical surface 12, the substrate 22 and the vertical surface 12 define pockets 26 that are initially filled with air. Upon applying pressure to the container 10, air is released from the pockets 26, causing the container 10 to adhere to the vertical surface 12 via suction. In other words, the concave surface (25) of each recess (24) and the vertical surface (12) define pockets (26) having a partial vacuum that causes the container 10 to adhere to the vertical surface 12.

Figure 5:
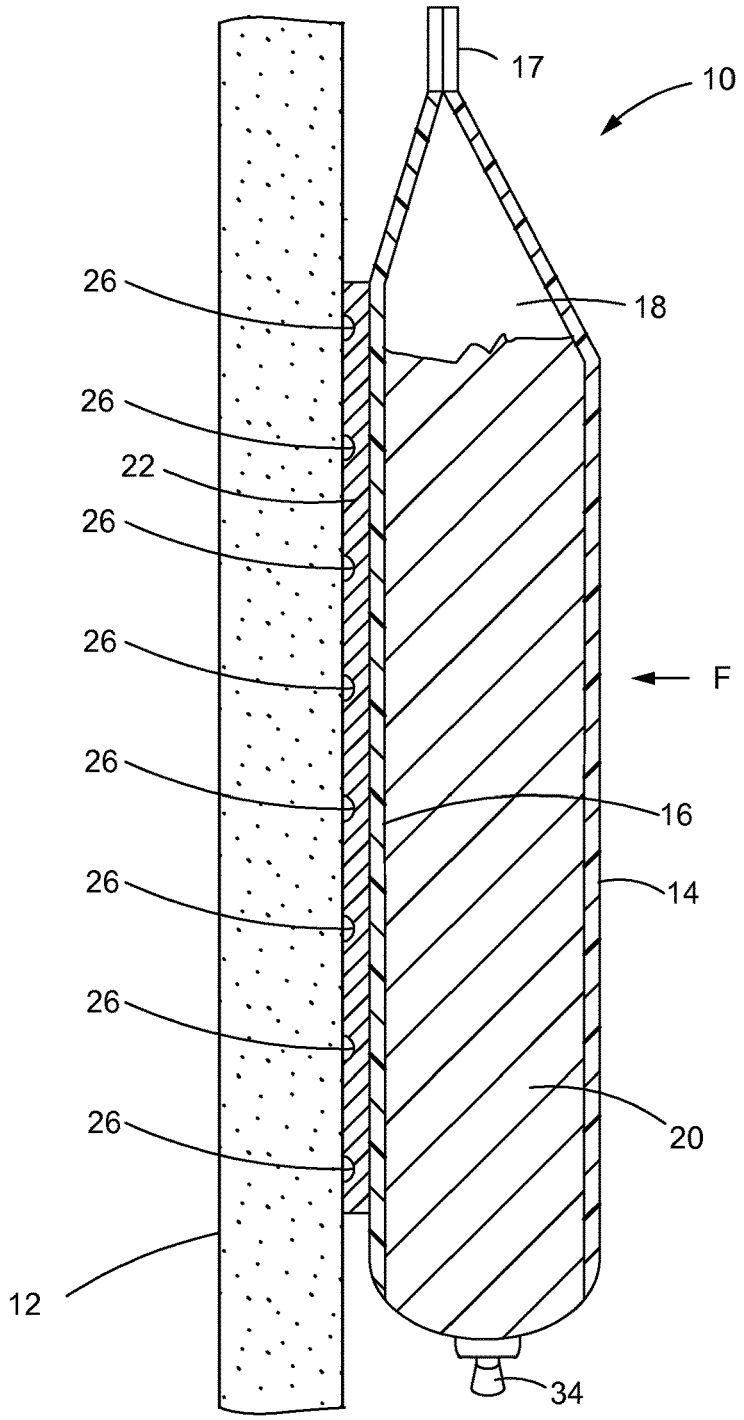
FIG. 5 is a cross-sectional view of the container of FIG. 1 taken along line 5-5 and shown attached to a vertical surface.

FIG. 5 is a cross-sectional view of the container of FIG. 1 taken along line 5-5 and shown attached to a vertical surface 12. To affix the container 10 to the vertical surface 12, the container 10 should be positioned against the vertical surface 12 so that the substrate 22 is contacting the vertical surface 12 and so the substrate 22 and the vertical surface 12 define closed pockets 26 which may be initially filled with air. The closed pockets 26 are of course simply the recesses 24 that have been sealed at their openings 29 by the vertical surface 12.

Preferably the container 10 is mounted with the nozzle 34 pointing down so that a user can dispense product 20 by opening the nozzle 34 and applying a force (F) against the front wall 14, such as by hand pressure. Preferably the force (F) is applied across a broad area of the front wall 14 to assure good contact between the substrate 22 and the vertical surface 12.

Applying a force (F) to the front wall 14 causes the recesses 24 to distort, forcing air out of the pockets 26 and creating a partial vacuum within the pockets 26. After releasing the force (F), the container 10 adheres to the vertical surface (12) via suction. During the force application step, channels may be created that temporarily enable the recesses 24 to communicate with the exterior until the pressure is released.

The container 10 is now adhered to the shower wall 12 and is ready to use. Product 20 may be dispensed by opening the nozzle 34 and then applying a force to the front wall 14 of the container 10. After dispensing the product 20 the user can close the nozzle 34 and leave the container 10 adhered to the vertical surface 12 for future use. When the container 10 is empty it can be removed from the vertical surface 12 by pulling on the container 10 to break the suction seals.

To aid in dispensing product 20 the container 10 may have a pressure activated nozzle 34 that automatically opens when the pressure inside the container 10 exceeds a predetermined level. In this way a user can simply push against the container 10 to dispense product without needing to first open the nozzle 34. If the container 10 is equipped with a pressure activated nozzle then the nozzle should be automatically closed while the container 10 is adhered to the vertical surface 12 and in its unpressurized state.

Figure 6:
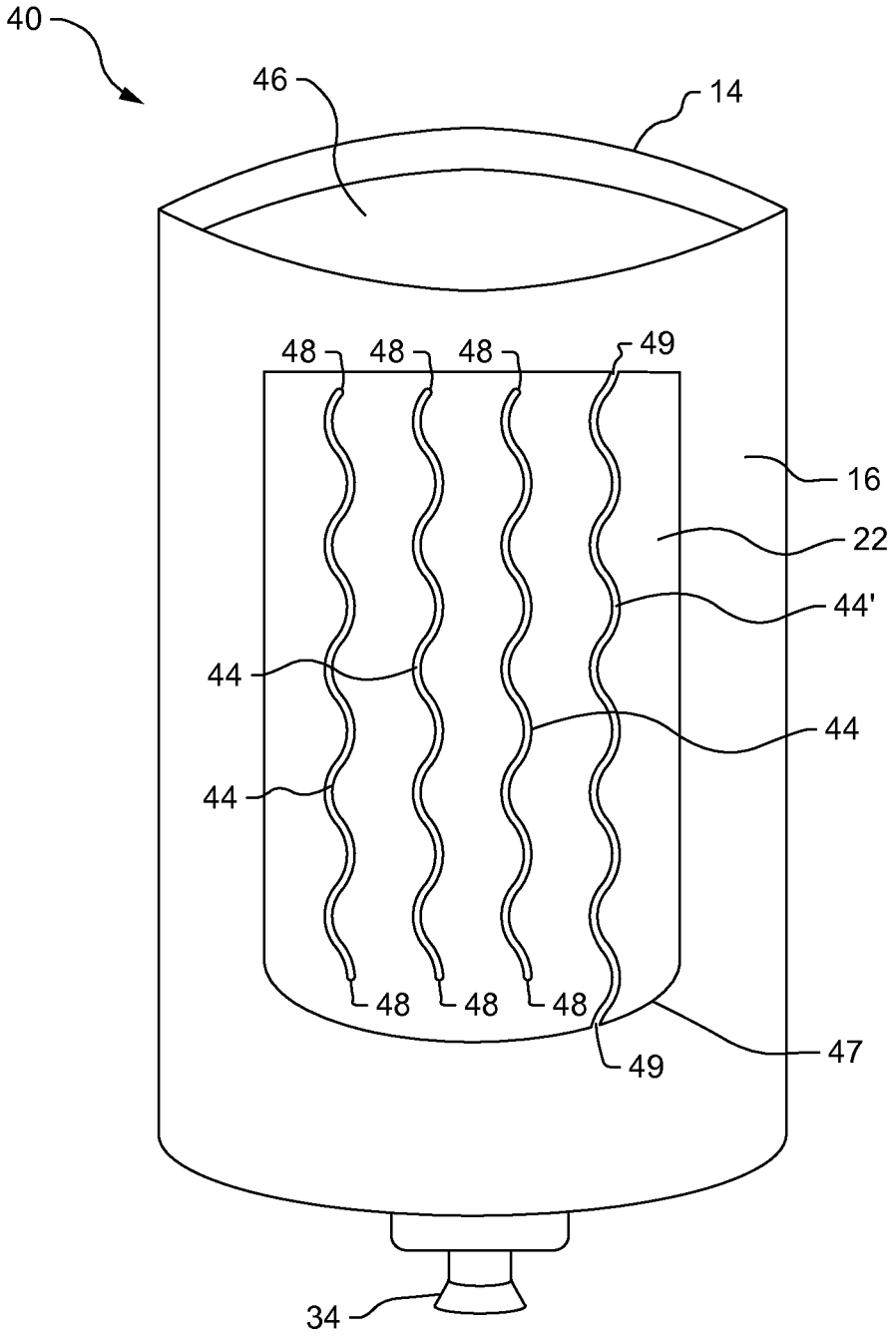
FIG. 6 is a rear view of a second embodiment of a container according to the disclosure.

FIG. 6 is a rear view of a second embodiment of a container 40 according to the disclosure. The container 40 comprises a front wall 14 and a flexible rear wall 16. A top panel 46 may connect the front wall 14 and the back wall 16 to seal off the top end of the container 40. A nozzle 34 may be affixed to the bottom end of the container 10. A substrate 22 is affixed to the rear wall 16. A plurality of recesses 44 are formed in the substrate 22. The recesses 44 take the form of continuous grooves or channels extending substantially vertically from an end opposite the nozzle 34 to the nozzle 34 to better expel water that may enter the recesses 44.

The substrate 22 may define any suitable number of grooves. The exact shape, dimensions and orientation of the grooves 44 may vary. For example, the grooves 44 may extend substantially horizontally or assume a more angular zig-zag shape.

The grooves 44 may terminate in closed ends 48 located within the substrate 22. Alternatively, one or both ends 49 of the grooves 44' may extend to and communicate with the periphery 47 of the substrate 22 and thus communicate with the exterior even when the container 10 is adhered to a vertical surface.

Figure 7:
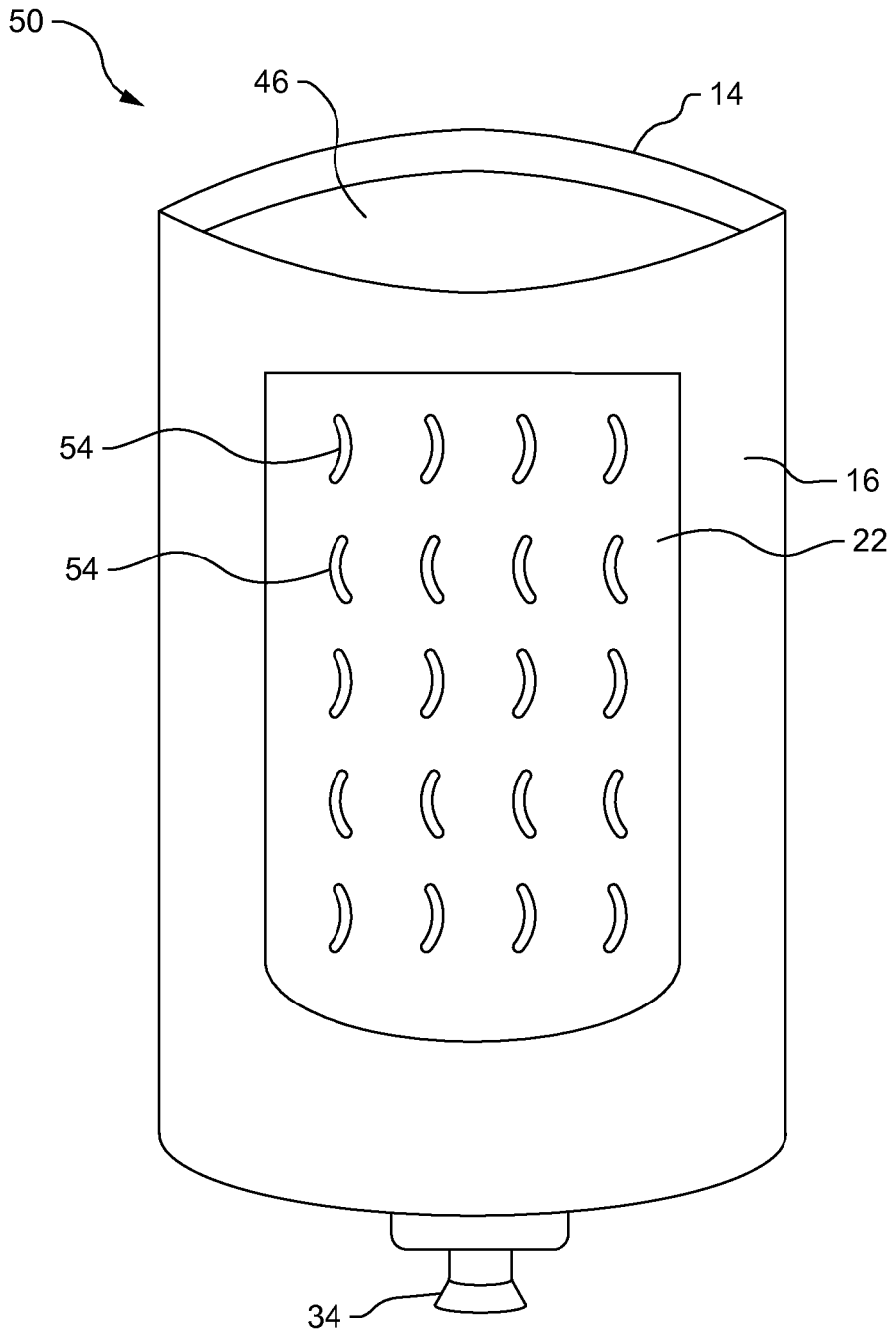
FIG. 7 is a rear view of a third embodiment of a container according to the disclosure.

FIG. 7 is a rear view of a third embodiment of a container according to the disclosure. The container 50 comprises a front wall 14 and a flexible rear wall 16. A substrate 22 is affixed to the rear wall 16. A plurality of recesses 54 are formed in the substrate 22. The recesses 54 take the form of segmented (discontinuous) grooves or channels. The groove segments 54 extend substantially vertically to better expel water. The exact shape, dimensions and orientation of the groove segments 54 may vary.

Figure 8:
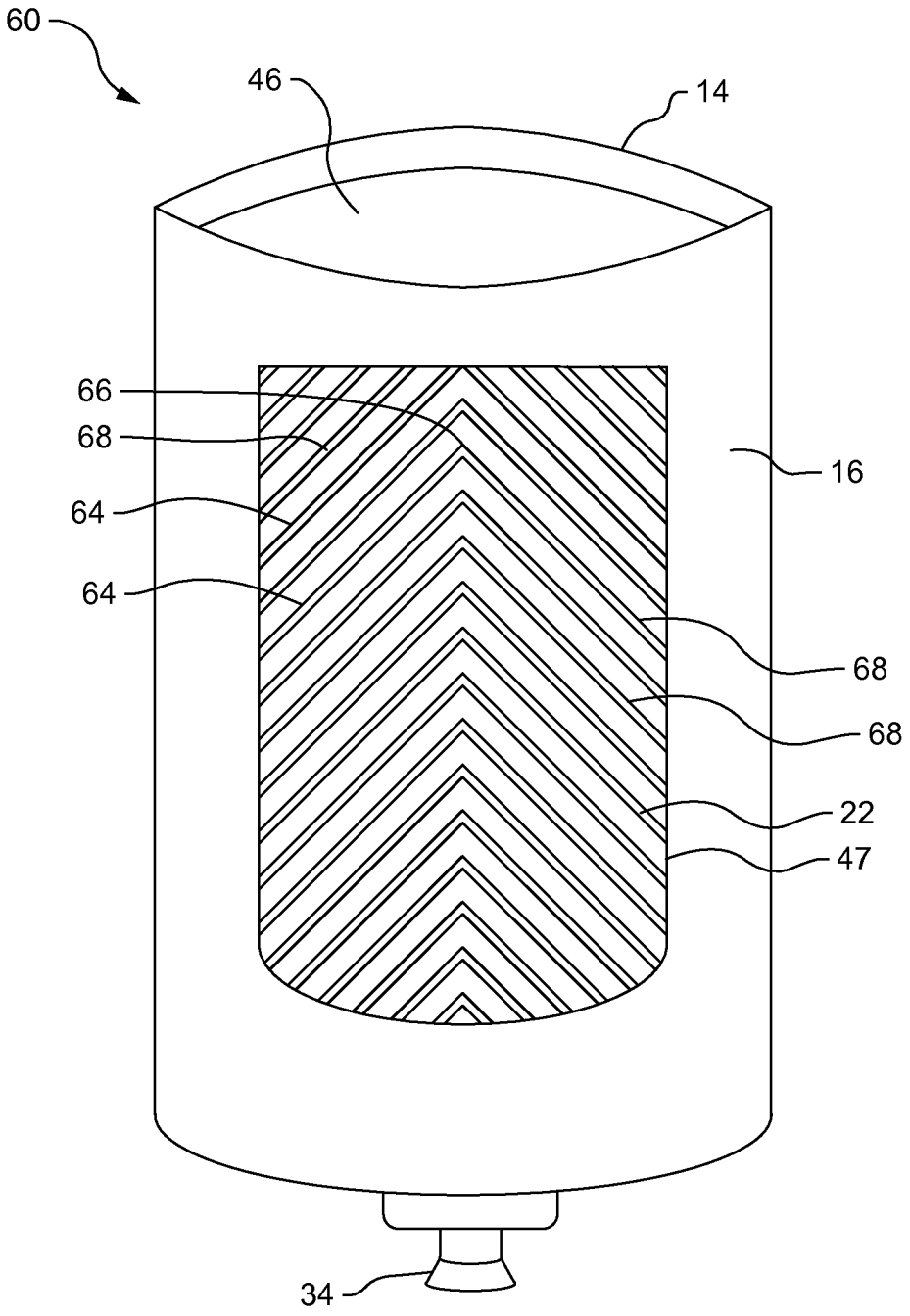
FIG. 8 is a rear view of a fourth embodiment of a container according to the disclosure.

FIG. 8 is a rear view of a fourth embodiment of a container 60 according to the disclosure. The container 60 comprises a front wall 14 and a flexible rear wall 16. A substrate 22 is affixed to the rear wall 16. A plurality of recesses 64 are formed in the substrate 22. The recesses 64 take the form of grooves or channels. Each groove 64 forms a V-shape having an apex 66 and two legs 68 extending obliquely downward from the apex 66 away from each other. The exact shape, dimensions and orientation of the grooves 64 may vary. The grooves 64 may terminate in closed ends located within the substrate 22. Alternatively, one or both ends may extend to the periphery 47 of the substrate 22 as shown in FIG. 8 and thus communicate with the exterior even when the container 10 is adhered to a vertical surface.

Method of Use

In another aspect of the disclosed technology a method of adhering a container 10 to a vertical surface 12 is provided. The method may comprise the following steps:

providing a container 10 comprising a front wall 14, a flexible rear wall 16 substantially coextensive with and affixed to the front wall 14, the front and rear walls 14, 16 defining an interior 18 for holding fluid product 20, and a substrate 22 affixed to the rear wall 16, the substrate 22 defining a plurality of integrally formed recesses 24;

positioning the container 10 such that the substrate 22 is contacting the vertical surface 12 and so that the substrate 22 and the vertical surface 12 define pockets 26 filled with air;

applying a force (pressure) to the front wall 14 so that air is released from the pockets 26; and releasing the force, leaving the container 10 adhered to the vertical surface 12 via suction.

During the force application step, channels may be created that temporarily enable the pockets 26 to communicate with the exterior until the force is released.

INDUSTRIAL APPLICABILITY

The container is intended for household use but may be used in other environments where it is desirable to having a container that can be easily and removably affixed to a surface, particularly a vertical surface, particularly a wet vertical surface.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A container that can be mounted on a shower wall, the container comprising:

a flexible front wall;

a flexible rear wall substantially coextensive with and affixed to the front wall, the front and rear walls defining an interior for holding a flowable personal care product; and a substrate affixed to the rear wall and having an outer surface and a substrate thickness, the substrate defining a plane and a plurality of recesses, wherein each of the plurality of recesses is defined by an outer facing concave surface extending inward into the substrate from the outer surface by a distance that is less than the substrate thickness, wherein when the substrate is forced into contact with the shower wall, the concave surfaces of the plurality of recesses combine with the shower wall to define pockets having a partial vacuum to retain the container in contact with the shower wall.

2. The container of claim 1 wherein:

each recess is a semi-spherical depression having outer facing concave surface and a rim, the rim having a diameter.

3. The container of claim 2 wherein:

the diameters of the recesses are substantially the same.

4. The container of claim 2 wherein:

the diameters of the recesses vary.

5. The container of claim 1 wherein:

the substrate is made from a water resistant silicone polymer.

6. A shower wall comprising:

a container comprising:

a flexible front wall, a flexible rear wall substantially coextensive with and affixed to the front wall, the front and rear walls defining an interior for holding a flowable personal care product, and a substrate affixed to the rear wall and having an outer surface and a substrate thickness, the substrate defining a plane and a plurality of recesses, wherein each of the plurality of recesses is defined by an outer facing concave surface extending inward into the substrate from the outer surface by a distance that is less than the substrate thickness; and a vertical surface defining a portion of the shower wall, wherein the substrate of the container is forced into contact with the vertical surface so that the concave surface of each recess and the vertical surface define pockets having a partial vacuum to retain the container in contact with the vertical surface.

7. The shower wall of claim 6 wherein:

the container comprises a nozzle; and the container is mounted to the vertical surface with the nozzle pointing down.

8. The shower wall of claim 6 wherein:

the nozzle is pressure activated.

9. The container of claim 1 wherein:

the recesses comprise grooves.

10. The container of claim 9 wherein:

the grooves extend substantially vertically from an end of the container to a nozzle opposite the end.

11. The container of claim 10 wherein:

the grooves are configured to expel water.

12. The container of claim 11 wherein:

the substrate has a periphery;

the grooves terminate in ends; and at least one end communicates with the periphery.

13. The container of claim 1 wherein:

the recesses comprise a plurality of groove segments extending substantially vertically.

14. The container of claim 1 wherein:

the recesses comprise a V-shape groove having an apex and two legs extending downward from the apex.

15. The container of claim 14 wherein:

the substrate has a periphery;

the grooves communicate with the periphery.

* * * * *